US005081445A

United States Patent [19]

Gill et al.

[11] Patent Number: 5,081,445

[45] Date of Patent: Jan. 14, 1992

[54] METHOD FOR TAGGING ARTICLES USED IN CONJUNCTION WITH AN ELECTRONIC ARTICLE SURVEILLANCE SYSTEM, AND TAGS OR LABELS USEFUL IN CONNECTION THEREWITH

[75] Inventors: Peter L. Gill, Long Valley; Anthony F. Piccoli, Audubon, both of N.J.

[73] Assignee: Checkpoint Systems, Inc., Thorofare, N.J.

[21] Appl. No.: 674,425

[22] Filed: Mar. 22, 1991

[51] Int. Cl.[5] ..... G08B 13/14; H01Q 1/36

[52] U.S. Cl. ..... 340/572; 343/895

[58] Field of Search ..... 340/572, 551; 343/894-895

[56] References Cited

U.S. PATENT DOCUMENTS

| | | | |
|---|---|---|---|
| 3,493,955 | 2/1970 | Minasy | 340/572 |
| 3,500,373 | 3/1970 | Minasy | 340/572 |
| 3,810,147 | 5/1974 | Lichtblau | 340/572 |
| 3,828,337 | 8/1974 | Lichtblau | 340/572 |
| 3,913,219 | 10/1975 | Lichtblau | 29/592 |
| 3,967,161 | 6/1976 | Lichtblau | 340/572 X |
| 4,141,078 | 2/1979 | Bridges, Jr. et al. | 340/572 X |
| 4,498,076 | 2/1985 | Lichtblau | 340/572 |
| 4,567,473 | 1/1986 | Lichtblau | 340/572 |
| 4,673,923 | 6/1987 | Boscoe et al. | 340/572 |
| 4,682,154 | 7/1987 | Fearon et al. | 340/572 |
| 4,742,341 | 5/1988 | Hogen Esch | 340/572 |
| 4,745,401 | 5/1988 | Montean | 340/572 |
| 4,794,470 | 12/1988 | Lauffenburger et al. | 340/572 X |

*Primary Examiner*—Glen R. Swann, III
*Assistant Examiner*—Thomas J. Mullen, Jr.
*Attorney, Agent, or Firm*—Weiser & Stapler

[57] ABSTRACT

Electronic article surveillance (EAS) tags are attached to articles of merchandise, not at the stores using EAS equipment, but in conjunction with the manufacture of these articles. At that stage, the tags are not detectable by the EAS equipment. They are made detectable upon receipt by an EAS-using store. For swept frequency RF EAS equipment, the tags are initially provided with two capacitors which make the tags resonant at a first frequency not detectable by the store's EAS equipment. To activate them, one capacitor is disabled, thereby making the tags resonant at a different frequency which is detectable.

24 Claims, 2 Drawing Sheets

METHOD FOR TAGGING ARTICLES USED IN CONJUNCTION WITH AN ELECTRONIC ARTICLE SURVEILLANCE SYSTEM, AND TAGS OR LABELS USEFUL IN CONNECTION THEREWITH

This application is a continuation of application Ser. No. 07/429,413 filed Oct. 31, 1989, now abandoned.

BACKGROUND OF THE INVENTION

The present invention relates generally to so-called "electronic article surveillance", and in particular, to a system which involves the use of electronically detectable tags or labels which are attached to articles of merchandise in order to protect these articles from unauthorized removal, such as by shoplifting.

For enhanced security and inventory control, the use of electronic article surveillance (EAS) systems has become increasingly widespread. These systems utilize tags or labels which contain an electronic circuit (e.g., a resonant circuit) for interacting with an applied (e.g., swept radio-frequency) electromagnetic field. A transmitter and accompanying antenna produce this field, and a nearby receiver and accompanying antenna detect variations in the received field caused by the presence of a tag. This transmitting and receiving equipment is positioned at the location or locations where it is desired to detect the unauthorized removal of tag-bearing articles, e.g., at the exit of a retail store.

The tags attached to those articles whose removal is authorized (e.g., because these articles have been properly checked out) are either physically removed from the articles, or deactivated, i.e. treated so that they become incapable of producing detectable variations in the received field. Otherwise, these tags will be detected and an alarm signal will be produced by the equipment. Commercial EAS systems as generally described above are available from manufacturers such as Checkpoint Systems, Inc. of Thorofare, N.J., among others.

An important consideration in the use of such EAS systems is the manner in which the detectable tags or labels are applied to the articles which are to be protected. Some retail stores, for example, wish to have tags applied to all the articles in their inventory, while others wish to have tags applied only to some of these articles, leaving others untagged. Likewise the selection of the kinds of merchandise to be tagged may vary from store to store, and from time to time within the same store. Even within a common "family" of stores, such as the member stores of a chain, these practices may—and frequently do—vary from one store to another. This variety, coupled with the absence until now of any practical technique for avoiding local tag application, has led to the common practice for users of EAS systems to tag articles locally, at each EAS-equipped store.

However, such "store" tagging is time consuming and labor intensive. Also, store tagging is often delegated to personnel who may be limited in training or interest This can compromise the effectiveness of EAS, which is obviously significantly dependent upon proper tagging of the articles to be protected.

In view of all this, theoretical consideration has previously been given to the possibility of performing the desired tagging of articles at some other point, upstream from the store itself in the distribution chain, such as at the merchandise manufacturing stage, or at some intermediate stage of warehousing or distribution. This theoretical possibility has not found practical realization because of certain formidable obstacles.

If detectable tags were to be applied to articles of merchandise at their manufacturing stage, then a given product line would have to be processed in two different varieties, one tagged and one not tagged. Moreover, this segregation would have to be perpetuated throughout the subsequent distribution channels. The reason for this is that many—indeed most—stores do not yet use EAS. These non-EAS using stores would need to be reliably supplied with non-tagged articles; otherwise EAS tags would leave these stores, still attached to the articles being sold, and thereby create what is sometimes called "pollution" of the marketplace with EAS tags. Conversely, stores which do use EAS would have to be reliably supplied with tagged articles, or their EAS protection would become ineffective.

If, on the other hand, EAS tags were to be applied at an intermediate distribution stage, this would require breaking the bulk packaging which is typically used at those stages, handling the individual articles, and repackaging them in bulk. Furthermore, subsequent segregation of tagged and not-tagged articles would again be required.

SUMMARY OF THE INVENTION

It is therefore the primary object of the present invention to provide a technique for protecting articles by means of EAS, without having to apply the necessary detectable tags or labels to these articles at the actual EAS-using stores.

It is also an object of the present invention to provide a tagging technique which no longer requires a store to individually tag articles which are to be protected by EAS.

It is also an object of the present invention to provide a tagging technique which can be performed without having to break the bulk packaging of the articles to be protected by EAS.

It is also an object of the present invention to provide a tagging technique which can be performed without having to break bulk packaging, while still enabling individual stores to adhere to their individual practices with regard to which articles are to bear EAS detectable tags.

It is also an object of the present invention to provide an EAS tagging technique which makes it unnecessary to create two segregated varieties of the same articles, one tagged and one not tagged, upstream from the stores in which these articles are to be retailed.

It is also an object of the present invention to provide EAS tags or labels which are particularly suitable for the achievement of the above-stated objects.

These and other objects are achieved in accordance with the present invention by tagging the articles in question, not at the individual EAS equipped stores, as heretofore, but upstream in the distribution chain, preferably in conjunction with their manufacture. This upstream tagging is performed by means of tags which, at that stage, are not yet detectable by the EAS equipment with which they are ultimately destined to function. Furthermore, these tags remain undetectable through the subsequent distribution channel, until they reach that stage at which it is inherently determined that all the so-tagged articles in a given bulk package will be used in an EAS-equipped store. This will typically occur at the merchandise-receiving facility of such an individual store. At that stage, the tags previously attached to the individual articles are rendered detectable and the articles with the now-detectable tags attached, are then processed through the store in conventional manner.

By proceeding in accordance with the present invention, the time and labor required for store tagging is eliminated and the reliability of the tagging procedure greatly enhanced. Moreover, it becomes practical to tag articles in ways which are less visible to the shopper, thereby further improving the protection provided by EAS, and also overcoming possible esthetic as well as functional objections to the use of visible EAS tags.

For further details, reference is made to the detailed description which is provided below, taken in conjunction with the accompanying drawings.

BRIEF DESCRIPTION OF THE DRAWINGS

In the several figures, like reference numbers denote similar structure.

DETAILED DESCRIPTION OF PREFERRED EMBODIMENTS

Figure 1:
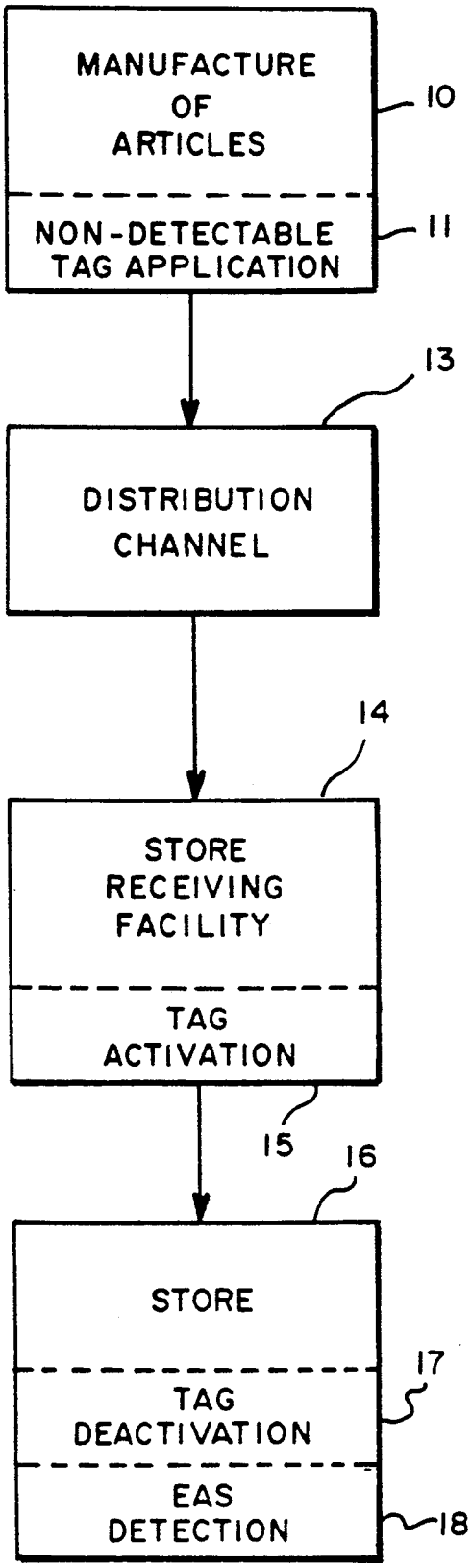
FIG. 1 a flow diagram of the EAS tag treatment technique embodying the present invention.

Referring to the flow diagram of FIG. 1, block 10 represents the manufacturing stage of the articles of merchandise which are to be subjected to the technique embodying the present invention.

As indicated by block 11, in accordance with the invention EAS tags are applied to these articles in conjunction with their manufacture.

Further in accordance with the present invention, these tags are then in a state in which they would not be detectable by the particular type of EAS equipment with which they are designed to ultimately function.

Block 13 represents the distribution channel through which these now-tagged articles then pass on their way to the retail stores.

Block 14 represents the merchandise receiving facility of one of these retail stores.

Block 15 represents means, located preferably at store receiving facility 14, for "activating" the EAS tags attached to the articles which reach receiving facility 14 from distribution channel 13. By "activating" is meant rendering these tags detectable by the store's EAS equipment.

Block 16 represents the retail store in which the received articles, now bearing tags which are detectable, are displayed for retail sale.

Block 17 represents the means, in store 16, for deactivating those tags which are attached to articles whose removal from store 16 has become authorized, by virtue of the fact that these articles have been properly checked out.

Block 18 represents the EAS detection equipment with which the store 16 is equipped and the activity of detecting tags which have not been deactivated at check-out.

In the flow diagram of FIG. 1, the manufacturing stage represented by block 10 may be entirely conventional, with the sole exception that EAS tags are applied to the merchandise at that stage. However, this application can also be carried out by various, but well known and conventional means. For example, an EAS tag may simply be adhesively attached either to each article itself, or to the individual package for that article. Since these EAS tags are typically similar in external configuration to a thick piece of paper, an inch or two square, and coated on one side with pressure sensitive adhesive, such application may involve nothing more than simply pressing them against a surface of the article or its individual packaging. In this regard, the application procedure may be the same as would previously have been performed at the retail store, itself, except that it can now be performed more efficiently, and more reliably, by means of the same type of machinery which is conventionally used in manufacturing to apply other kinds of tags and labels to articles of merchandise.

The distribution channel represented by block 13 in FIG. 1 may be entirely conventional, comprising the various transportation means for moving merchandise to retail stores, the warehouses in which it is stored, etc. While in this channel, the merchandise is typically contained in bulk packaging, such as cardboard cases, each containing multiple units of the individual articles. In accordance with the present invention, these cases now contain articles to which not-yet-detectable EAS tags have already been attached.

Store receiving facility 14 may also be conventional, in that it comprises the customary unloading location and material handling equipment used by retail stores to receive their merchandise.

However, in accordance with the invention, there is also provided at this receiving facility 14 the means 15 for activating the heretofore not-detectable tags attached to the received merchandise. How this is done is described later in this specification.

Thereafter, this received merchandise is treated in the same way as in any other EAS equipped store. That is, it is processed through store 16 in conventional manner, e.g. by being displayed in the merchandise display area and checked out after being selected by customers for purchase. As part of the check-out operation, the EAS tags are subjected to deactivation by means 17, or alternatively are detected by EAS detection equipment 18 upon unauthorized removal. All of this may be accomplished in completely conventional manner by completely conventional means.

In particular, the conventional EAS equipment 18 used to detect EAS tags which have not been deactivated by means 17 may be of the so-called swept-frequency RF type. Briefly, this type of equipment transmits a radio frequency (RF) signal whose frequency is periodically varied between, say, 7.4 and 9.0 MHz. The EAS tags for use with this type of equipment comprise an inductor-capacitor (LC) circuit which is resonant within that transmitted band, e.g. at approximately 8.2 MHz. The presence of the EAS tag distorts the RF signal and that distortion is detected by a nearby receiver which then gives an alarm.

Such swept-frequency RF EAS detection equipment is disclosed for example, in U.S. Pat. Nos. 3,500,373, 3,810,147 and 3,828,337, the contents of which are incorporated herein by reference. As for the deactivating means 17, this may also operate on a swept-frequency RF basis in the 7.4 to 9.0 MHz range. Such deactivating means is disclosed, for example, in U.S. Pat. Nos.

4,498,076 and 4,567,473, the contents of which are also incorporated herein by reference.

Commercial EAS detection equipment, as well as deactivation equipment of this swept-frequency RF type is available from Checkpoint Systems, Inc. of Thorofare, N.J., which is also the assignee of the present invention.

Figure 4:
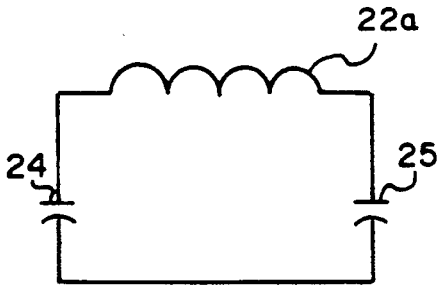
FIG. 4 is a diagram of the equivalent circuit of the tag of FIG. 2.
Figure 2:
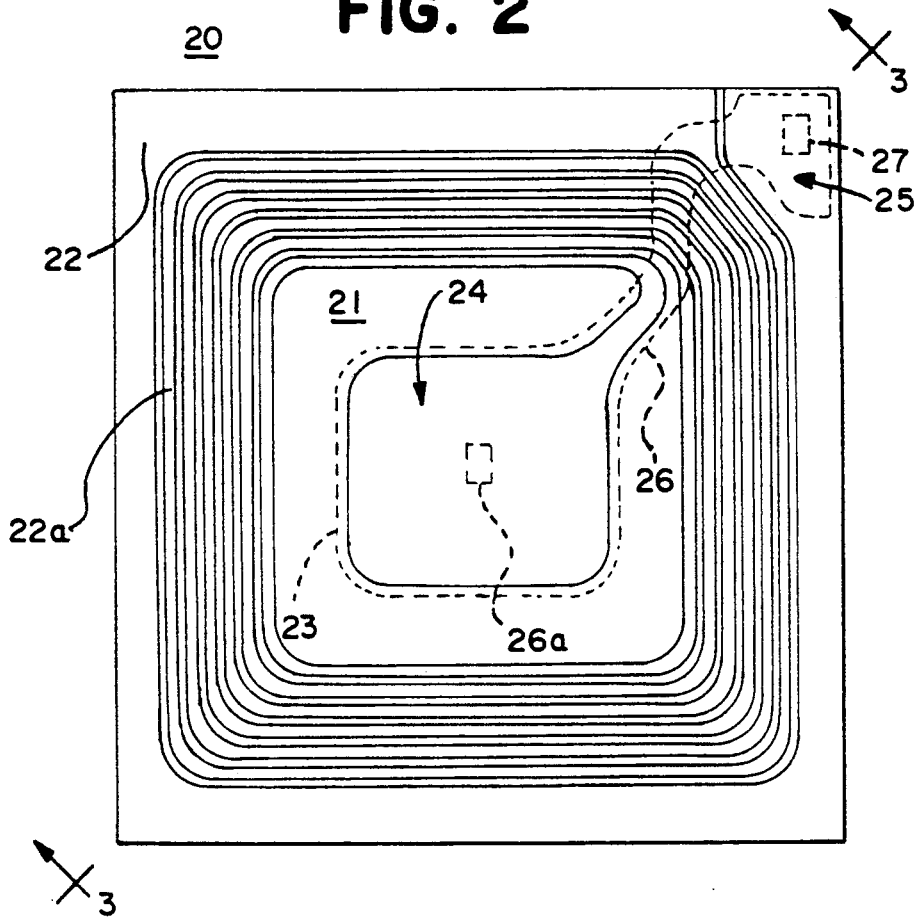
FIG. 2 is a diagrammatic plan view of a tag which is useful in implementing the technique diagrammed in FIG. 1.
Figure 3:
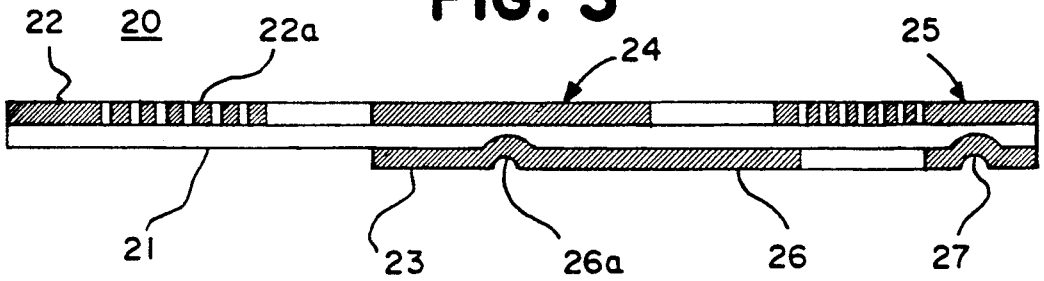
FIG. 3 is a diagrammatic cross-sectional view of the tag of FIG. 2, taken along the line 3—3 in FIG. 2.

Turning now to FIGS. 2, 3 and 4, these diagrammatically illustrate a kind of EAS tag which is suitable for use in the practice of the present invention, in conjunction with EAS equipment of the above-mentioned swept-frequency RF type.

This tag 20 comprises a dielectric substrate 21, which may be made of polyethylene and which bears on each side a conductive pattern 22 and 23, respectively, which may be of aluminum.

As is particularly clearly visible in FIG. 2, the angular spiral portion of pattern 22 defines an inductor 22*a*, while the square portion in the center defines one plate of a capacitor 24. The opposite plate of capacitor 24 is defined by the corresponding square portion of pattern 23 which is shown in phantom by broken lines in FIG. 2. One plate of a second, smaller capacitor 25 is defined by the triangular portion at the upper right-hand end of the spiral portion of pattern 22. The opposite plate of this second capacitor 25 is defined by the corresponding triangular portion of pattern 23 shown in phantom by broken lines in FIG. 2. Also in pattern 23, a conductive path 26 (shown in phantom by broken lines in FIG. 2) connects the plates of capacitors 24 and 25.

Referring to FIG. 4, the equivalent circuit of the EAS tag 20 shown in FIGS. 2 and 3 is seen to consist of a resonant circuit defined by inductor 22*a* and capacitors 24 and 25.

In accordance with the present invention, the tag 20 is further provided with two indentations, 26*a* and 27. Indentation 26*a* is formed in capacitor 24, while indentation 27 is formed in capacitor 25.

Given that the EAS equipment 18 in FIG. 1, by which tag 20 is to be ultimately detectable, and the deactivating equipment 17 by which tag 20 is to be ultimately capable of being deactivated, are both of the swept-frequency RF type previously mentioned, with transmitted signals varying in frequency between 7.4 and 9.0 MHz, then the values of inductor 23 and capacitors 24 and 25 are so chosen that tag 20 initially forms an LC circuit which is resonant at a frequency substantially above the 7.4 to 9.0 MHz range, e.g. at a frequency of approximately 18 MHz. The values of inductor 22*a* and capacitor 24 are further so chosen that, if capacitor 25 is shorted out, then tag 20 forms an LC circuit which is resonant within the 7.4 to 9.0 MHz range, e.g. at approximately 8.2 MHz.

The above-mentioned U.S. Pat. Nos. 4,498,076 and 4,567,473 disclose the use of indentations such as 26*a* and 27 provided in capacitors 24 and 25 of tag 20 in order to create a short circuit between the conductive patterns on opposite sides of the dielectric substrate. In these U.S. Patents, the shorting out is used to deactivate an EAS tag which is designed for use in conjunction with swept-frequency RF EAS equipment.

In the present invention, the indentation 26*a* in capacitor 24 is provided for the very same purpose, namely for use in ultimately deactivating tag 20 at stage 17 in FIG. 1. However, in the present invention, the indentation 27 in the other capacitor 25 is provided for the exact opposite purpose, namely for use in activating tag 20, which had previously been not-detectable at the EAS detection stage 18 in FIG. 1.

The electronic equipment which is used at activation stage 15 in FIG. 1 in cooperation with a tag 20 may be the same as illustrated and described in said U.S. Pat. Nos. 4,498,076 and 4,567,473, with two exceptions.

One exception is that the frequencies at which it operates are in a range which includes the higher frequency (of approximately 18 MHz) at which tag 20 is initially resonant. This higher range may be from 16.5 to 19.5 MHz.

The other exception is that this electronic equipment operates at a substantially higher power.

By operating in the higher frequency range, the equipment becomes capable of shorting out the capacitor 25 via indentation 27. By operating at high enough power, it becomes capable of shorting out that same capacitor simultaneously in a plurality of tags 20, such as would be present in a bulk package containing multiple units of merchandise articles to which such tags had been attached at the manufacturing and tag application stage 10, 11 of FIG. 1.

With their capacitors 25 so shorted out, all the tags 20 in the bulk package at receiving facility 14 in FIG. 1 have now become activated, and have therefore become detectable at stage 18 in completely conventional manner.

Moreover, they have now also become deactivatable at stage 17, also in completely conventional manner.

Detection at stage 18 would result simply from having such an activated tag 20 present in the swept-frequency RF field, whose distortion by that tag is then sensed by the EAS receiver, causing an alarm.

Deactivation at stage 17 would result from operating as disclosed in said U.S. Pat. Nos. 4,498,076 and 4,567,473, namely by shorting out capacitor 24 via its indentation 26. With both capacitors 24 and 25 (see FIG. 4) so shorted out via respective indentations 26, 27, the tag 20 again becomes undetectable at stage 18 of FIG. 1.

As previously noted, in order to perform the simultaneous activation of the tags attached to all the articles in a bulk package of merchandise, in accordance with the present invention, it may be necessary to operate the activating means 15 at higher power than the deactivating means 17, which is typically used to deactivate only one tag at a time. Such higher power may exceed the limit imposed by regulatory agencies such as the United States Federal Communications Commission. If that should be the case, then a simple treatment is to provide an enclosure which contains the RF fields produced by the activating means and which is large enough to contain both that means and the EAS tag bearing merchandise, still in its bulk package. This enclosure may take any of various conventional forms, such as a metal box. The same treatment, namely enclosure of the activating means and the bulk package, may also be used if the frequency range within which the activating signal is transmitted presents a problem in terms of regulatory requirements. That frequency range is preferably so chosen that it does not include integral multiples of the frequency range within which the deactivation signal is subsequently transmitted. That is to forestall the possibility that the activating signal may also cause deactivation of the now-activated tags due to possible spurious resonances at multiples of the resonant frequency of the activated tags.

As previously noted, in order to activate tag 20 by changing its resonant frequency from its initial value (e.g. approximately 18 MHz) to its second value (e.g. approximately 8.2 MHz), capacitor 25 is shorted out by the application of a sufficiently strong field at the initial frequency. The total voltage developed by this applied field will appear across the series combination of that capacitor 25 and capacitor 24 (see FIG. 4). However, this total voltage will be distributed between those capacitors in inverse proportion to their plate sizes. By making capacitor 25 substantially smaller than capacitor 24, the voltage across the former will always be substantially larger than that across the latter. In view of this, and in view of the fact that the indentations in both may be made substantially similar, capacitor 25 will break down before capacitor 24, as is desired.

By proceeding in accordance with this invention, it is not necessary to distinguish, in manufacturing or distribution, between products to be delivered to EAS equipped stores and others. Rather, all products can be tagged, and the EAS equipped stores themselves can then activate those which they receive, while other stores need do nothing at all.

Moreover, these tags can now be applied to the individual articles of merchandise in a manner which would not be convenient for store tagging. For example, there would be no problem, at the manufacturing and tag application stage (10, 11 in FIG. 1), to apply EAS tags on the inside of the "bubble pack" or on the inside of a cardboard box containing a particular article. This would have the advantage of concealing the EAS tag, so that a shopper would not even know that this particular article is protected.

It will be understood that many other variations are possible, in accordance with the present invention, without departing from the inventive concept.

For example, the invention is not limited to use with articles for sale in retail stores. Other applications can also benefit, such as book stores, video stores, etc.

As another example, the initial change in the tags' resonant frequency in order to "activate" it, need not necessarily involve an indentation in a capacitor such as indentation 27 shown in FIGS. 2 and 3. Rather, the tags may be provided with two sets of capacitors connected by a fusible link, as disclosed more fully in U.S. Pat. No. 3,967,161, whose contents are incorporated herein by reference. The fusible link may be opened at the activating stage 15 in FIG. 1 in order to change the frequency to that which will then be detectable by the store's EAS system. The even higher power which would be required to open such a fusible link is then dealt with by enclosure in an RF confining box, as previously discussed.

Also, although the preferred application of the invention is to situations in which all the tagged articles in a bulk package are activated simultaneously, it will be understood that the same technique can be utilized to activate these articles after they have been subdivided into smaller quantities, or even one at a time. The other advantages which arise from having applied the tags in conjunction with the manufacture will then still apply.

Accordingly, it is desired that the scope of the present invention be defined only by the appended claims.

We claim:

1. A method for providing a facility with articles to which devices have been attached which are capable of being detected by article surveillance equipment located at said facility, said method comprising:

attaching to said articles, before they reach said facility, devices which are not capable of being detected by said equipment, but which are capable of being activated to become capable of being so detected;

supplying said articles to said facility; and activating said devices upon receipt at said facility.

2. The method of claim 1, wherein the attaching is performed in conjunction with the manufacturing of the articles.

3. The method of claim 2, wherein the supplying is in bulk packages containing multiple units of said articles.

4. The method of claim 3, wherein the activating is performed while the articles are still in their bulk packages.

5. The method of claim 1, wherein the devices comprise electronic circuits which are resonant at a first frequency when supplied to said facility and are made resonant at a second frequency by the activating upon receipt at the facility.

6. The method of claim 5, wherein the circuits which are resonant at the first frequency are not detectable by said electronic article surveillance equipment, but the circuits which are resonant at the second frequency are so detectable.

7. A system for providing a facility with articles to which devices have been attached which are capable of being detected by article surveillance equipment, said system comprising:

means for attaching to said articles, before they reach said facility, devices which are not capable of being detected by said equipment, but which are capable of being activated to become capable of being so detected;

means for supplying said articles to said facility; and means for activating said devices upon receipt at said facility.

8. The system of claim 7, wherein the supplying means includes means for enclosing said articles in bulk packages containing multiple units of said articles with said devices attached.

9. The system of claim 8, wherein the activating means operates on the devices while the articles are still in their bulk packages

10. The system of claim 7, wherein the devices comprise electronic circuits which are resonant at a first frequency as supplied to said facility, and said activating means comprises means for making said circuits resonant at a second frequency.

11. The system of claim 10, wherein said electronic article surveillance equipment comprises means for detecting said circuits resonant at the second frequency.

12. The system of claim 11, wherein said facility is a retail store and the articles are articles of merchandise for said store.

13. The system of claim 12, wherein the supplying means is the distribution channel for the merchandise for said store.

14. A device for use in the system of claim 10, said device comprising a resonant circuit having two capacitors, whereby said circuit is resonant at said first frequency, and means for selectively disabling at least one of said capacitors, whereby said circuit becomes resonant at said second frequency.

15. The device of claim 14, wherein said capacitors are of different sizes and said disabling means comprises an indentation in one of said capacitors.

16. The device of claim 15, wherein there is also an indentation in the other one of said capacitors.

17. A device for interacting with an electronic article surveillance system, said device including a resonant circuit for interacting with an applied radio-frequency field produced by said electronic article surveillance system;

wherein said resonant circuit is configured to resonate at a first frequency corresponding to an operative frequency of said electronic article surveillance system in a first mode of operation;

wherein in a second mode of operation said resonant circuit is configured to resonate at a second frequency different from the operative frequency of said electronic article surveillance system, and is capable of activation for interacting with said electronic article surveillance system; and wherein said resonant circuit includes means for modification from said second mode of operation to said first mode of operation, which is operative at said second frequency.

18. The device of claim 17 wherein said resonant circuit is comprised of etched circuit portions formed on opposing sides of a substrate, and wherein said modification means is an indentation formed at a first selected location along one of said etched circuit portions to define a narrowed space between said etched circuit portions at said first selected location.

19. The device of claim 18 wherein said first location is selected to comprise a series resonant circuit operative at said first frequency following exposure of said device to an applied radio-frequency field at said second frequency.

20. The device of claim 19 wherein said device further comprises means for deactivating said resonant circuit following exposure of said device to an applied radio-frequency field at said first frequency.

21. The device of claim 20 wherein said deactivating means is an indentation formed at a second selected location along one of said etched circuit portions to define a narrowed space between said etched circuit portions at said second selected location.

22. The device of claim 21 wherein said second location is selected to develop a short circuit in said series resonant circuit following exposure of said device to an applied radio-frequency field at said first frequency.

23. The device of claim 22 wherein said device is configured so that the indentation provided at said first location will operate to complete said series resonant circuit before the indentation provided at said second location will operate to develop a short circuit in said series resonant circuit upon exposing said device to an applied radio-frequency field at said second frequency.

24. The device of claim 22 wherein said series resonant circuit includes two capacitor elements, a first of which defines said first location for an indentation and a second of which defines said second location for an indentation, and wherein the first of said capacitor elements is comprised of plate portions which are smaller than plate portions comprising the second of said capacitor elements.

* * * * *